United States Patent [19]

Pool

[11] Patent Number: 4,751,889

[45] Date of Patent: Jun. 21, 1988

[54] COLLAPSIBLE CANOE

[76] Inventor: Peter J. Pool, 75 Princes Hwy., Kirrawee, N.S.W., Australia

[21] Appl. No.: 15,163

[22] Filed: Feb. 17, 1987

[51] Int. Cl.[4] ..... B63B 7/06

[52] U.S. Cl. ..... 114/39.1; 114/90; 114/102; 114/347; 114/354

[58] Field of Search ..... 114/343, 347, 352, 353, 114/354, 355, 357, 39.1, 90, 93, 103, 102

[56] References Cited

U.S. PATENT DOCUMENTS 2,908,239 10/1959 Laine ..... 114/354
4,004,307 1/1977 Hermann ..... 114/354
4,274,170 6/1981 Simpson ..... 114/354
4,290,157 9/1981 Jensen ..... 114/354

*Primary Examiner*—Joseph F. Peters, Jr.
*Assistant Examiner*—Stephen P. Avila
*Attorney, Agent, or Firm*—Jeffers, Hoffman & Niewyk

[57] ABSTRACT

A canoe adapted to be collapsed or disassembled for transportation but which, when assembled is capable of use in sea-going applications, the canoe comprising a fore skeletal half frame and an aft skeletal half frame each comprising a number of separate frame members and releasably connected together by a plurality of over-center locking devices, and a hull skin adapted to sheath the half frames when connected together.

20 Claims, 4 Drawing Sheets

COLLAPSIBLE CANOE

This invention relates to collapsible or folding canoes and more particularly to a vessel of the kind which is able to be disassembled for packing into two or more "carry" bags when not in use.

So-called "folding canoes" have been known since before World War II but hitherto such have been confined to comparatively fragile craft quite unsuited to any use other than on bodies of water such as lakes, rivers, dams, sheltered inlets and the like, and certainly not on the open sea.

It is therefore an object of the present invention to provide a large and robust sea-going canoe, suitable for heavy usage by such as the armed forces, yet which can easily and rapidly be disassembled and packed into two or more carry bags.

To this end, then, there is provided, according to one aspect of present invention, a folding canoe including a fore skeletal half-frame and an aft skeletal half-frame releasably connectable together by a plurality of over-center locking devices, said fore skeletal half-frame comprising a stem post, a port bow keelson stringer connected thereto and hingedly connected to a port mid-forward keelson stringer, a starboard bow keelson stringer connected to said stem post and hingedly connected to a starboard mid-forward keelson stringer, a port bow gunwale stringer connected to said stem post and hingedly connected to a port mid-forward gunwale stringer, a starboard bow gunwale stringer connected to said stem post and hingedly connected to a starboard mid-forward gunwale stringer, a stem bulkhead and a mid-forward bulkhead, both releasably located within said fore skeletal half-frame;

said aft skeletal half-frame comprising a stern post, a port stern keelson stringer connected thereto and hingedly connected to a port mid-aft keelson stringer, a starboard stern keelson stringer connected to said stern post and hingedly connected to a starboard mid-aft keelson stringer, a port stern gunwale stringer connected to said stern post and hingedly connected to a port mid-aft gunwale stringer, a starboard stern gunwale stringer connected to said stern post and hingedly connected to a starboard mid-aft gunwale stringer, a stern bulkhead and a spaced-apart pair of mid-aft bulkheads, all three releasably located within said aft skeletal half-frame; and a hull skin adapted to sheath said half-frames when connected together.

The inventive canoe may well further include a mast-supporting tabernacle disposed above the mid-forward gunwale stringers intermediate the stem and mid-forward bulkheads and connected to the stem post via a foredeck fore-and-aft centerline member, a port mid-forward coaming connected to the tabernacle and hingedly connected to a port mid-aft coaming and a starboard mid-forward coaming connected to the tabernacle and hingedly connected to a starboard mid-aft coaming; the after ends of these coamings being releasably attachable to the stern bulkhead.

Preferably, a pair of elongated inflatable sponsons may be disposed in respective sponson pockets on the inside of the hull skin, one on each side of the canoe.

Ideally, the releasable fixings of bulkheads-to-keelson stringers, and of bulkheads-to-coamings, may be achieved by means of over-center locking devices of the 'quick-release' kind, while the keelson stringers of the two skeletal half-frames may be joined by 'heavy duty' locking devices as will hereinafter be described.

In order that the reader may gain a better understanding of the present invention, hereinafter will be described a preferred embodiment thereof, by way of example only and with reference to the accompanying drawings in which.

Figures 1, 2:
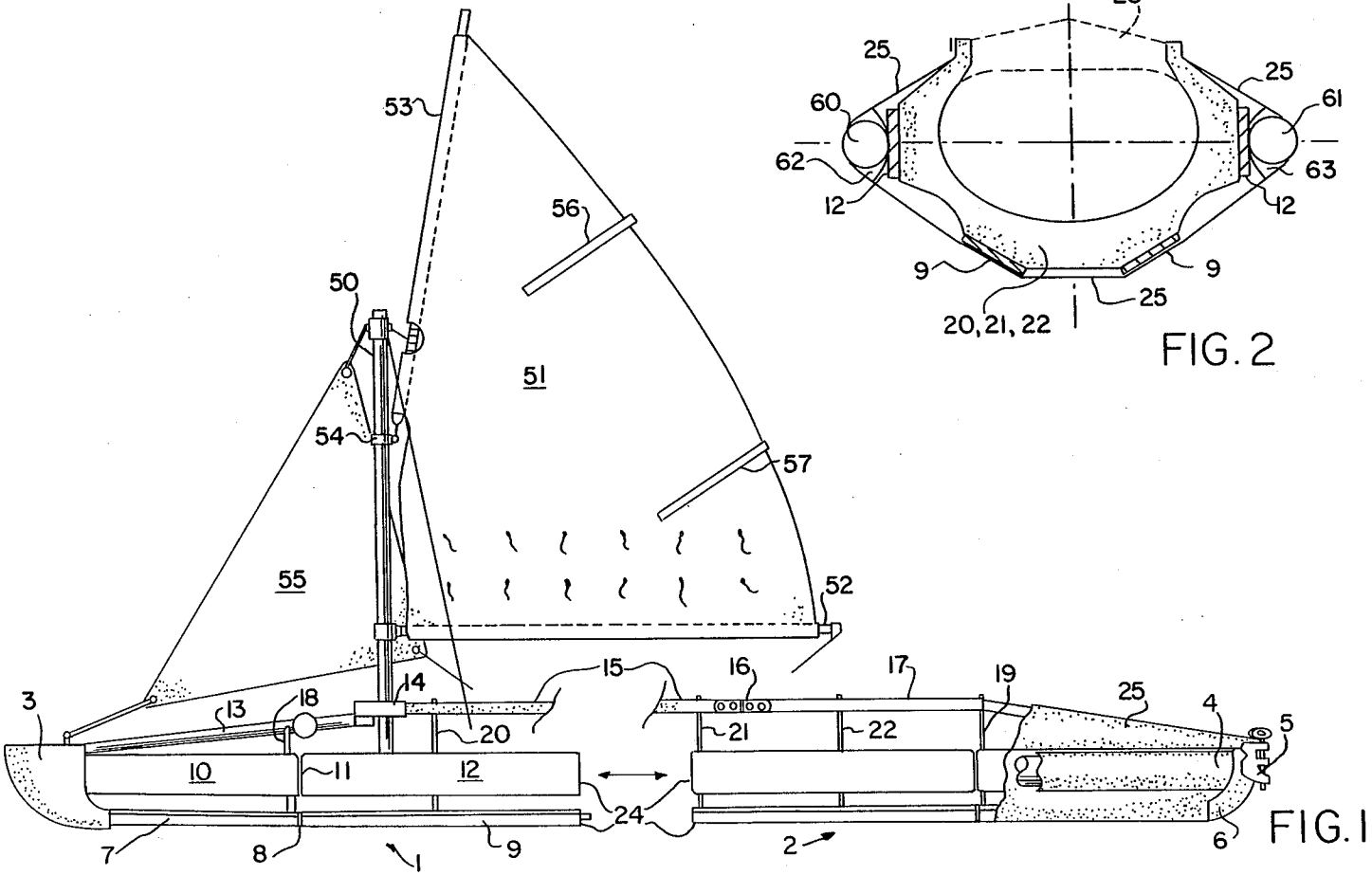
FIG. 1 is a side elevation of a two-man folding canoe according to the present invention.
FIG. 2 is a typical transverse cross-section through the vessel.

The skeletal frame is composed of twentynine primary components, namely stem and stern posts, eight keelson stringers, eight gunwale stringers, four coamings, five bulkheads and two deck centerline members. As will be seen in FIG. 1, the frame of the canoe includes a fore skeletal half-frame, generally referenced 1, and an aft skeletal half-frame, generally referenced 2.

The stem post 3 is preferably moulded from polyurethane which is effective to absorb energy in the event of bow impact. Stern post 4 is generally similar but is fitted with a cast aluminium rudder-post 5. External to the hull skin, and to the stem and stern posts 3 and 4, are polyurethane-coated black rubber protection strips, as that referenced 6.

Extending aft from stem post 3 are two keelson stringers, the port side keelson stringer 7 only being visible in FIG. 1. It is to be understood that the starboard side of the skeletal frame of the inventive folding canoe is a mirror-image of the port side described herein. Hingedly connected to these two bow keelson stringers at the points referenced at 8 are two mid-forward keelson stringers, as 9.

Also extending aft from stem post 3 are two gunwale stringers, the port side gunwale stringer 10 only being seen in FIG. 1. Hingedly connected to these two bow gunwale stringers at the points referenced 11 are two mid-forward gunwale stringers 12.

A forward deck centerline member 13 additionally extends aft from stem post 3 to connect with a mast-supporting tabernacle 14. This tabernacle has, converged upon it, port and starboard mid-forward coamings, as referenced 15, hingedly connected as at 16 to associated mid-aft coamings, as 17. The after ends of the port and starboard mid-aft coamings are releasably attachable to the stern bulkhead, as will be later set out. Thus, the plan of the four coamings is reminiscent of a gothic arch having its apex at the tabernacle 14.

Spacing apart and bracing the various keelson and gunwale stringers are five bulkheads; a stem bulkhead 18, a stern bulkhead 19 and three intermediate bulkheads 20, 21 and 22.

Turning now to FIG. 2, this shows a typical bulkhead and its essential spatial relationship to the associated skeletal frame members. In FIG. 2, a bulkhead is disposed between keelson and gunwale stringers as have been previously described. The particular bulkhead shown is one of three intermediate bulkheads and is "open" while the stem and stern bulkheads, 18 and 19 on FIG. 1, are "closed" as shown in chain-line at 23.

One longitudinal half of the skeletal frame has been described above; the other longitudinal half being substantially identical.

Each half-frame that is to say, the fore skeletal half-frame and the aft skeletal half-frame, can be collapsed or so folded up as to enable it to be packed in a "carry-bag"; the forward and aft deck centerline members are removed together with the four coamings, and the keelson and gunwale stringers folded at their hinge points so as to overlie each other.

As will be realised, the fore and aft skeletal half-frames can be releasably joined together at the mid-point 24, as will be described hereinafter and, in this regard, all the hinges, brackets, locking devices and the like yet to be described are fabricated from rust/corrosion resistant material such as stainless steel. The keelson and gunwale stringers can be of fibreglass "foam sandwich" construction, the bulkheads moulded from such as APT, the deck centerline members of such as fibreglass rod or tube, and the coamings of extruded aluminium.

Figure 3:
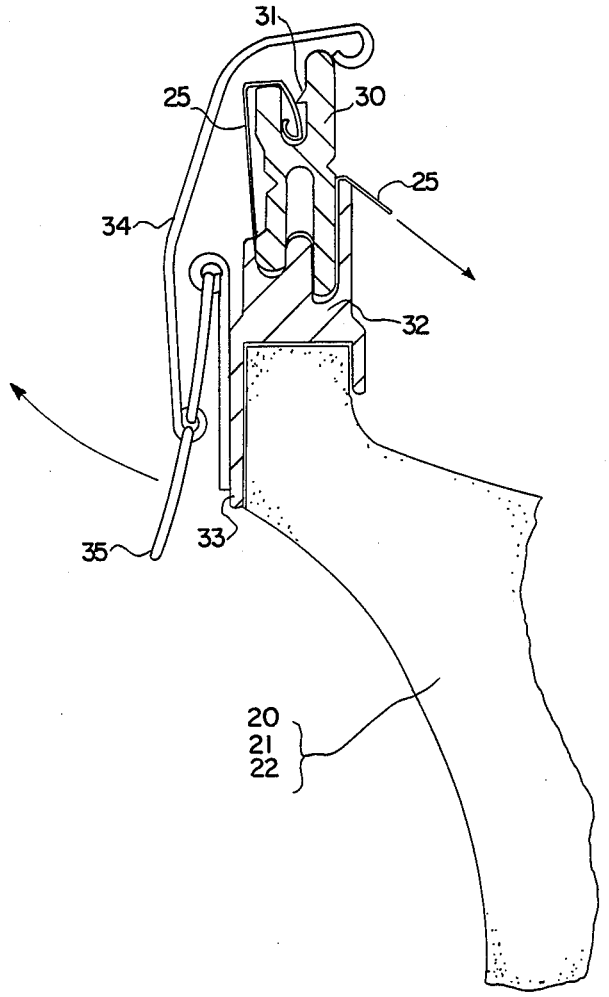
FIG. 3 shows a bulkhead-to-coaming quick-release, over-center locking device.

Covering the assembled skeletal frame is a hull skin, a one-piece element generally referenced 25 in FIGS. 1, 2 and 3.

To digress, it may here be said that the first step in the assembly of the inventive craft is to take the hull skin from its carry bag and to spread it out on a flat, preferably clean, surface. The fore and aft half-frames are then unfolded and pushed down into the respective fore and aft ends of the hull skin, and only then joined at the mid-point.

As regards the joining of the fore and aft skeletal half-frames, in FIG. 3 is to be seen a bulkhead-to-coaming quick-release, over-center locking device. The coaming is extruded aluminium and has a cross-section as referenced 30. To enable hull skin 25 to be firmly entrapped in the coaming section, the latter has a sharp land 31 which effectively immobilises hull skin 25 but enables it to be stretched over the skeletal frame. Further, to prevent the hull skin anchor from "wobbling" in the coaming grooves, a profiled extruded saddle 32 is interposed between the bulkhead, as 20, 21, 22 and coaming 30. The quick-release, over-center locking device includes a bracket 33 affixable to the bulkhead, a spring-clip member 34 and a linking, finger-actuated integer 35. It will be readily appreciated that appropriate manipulation of interger 35 will lock the coaming to, or release it from, the bulkhead via the saddle.

Figure 4:
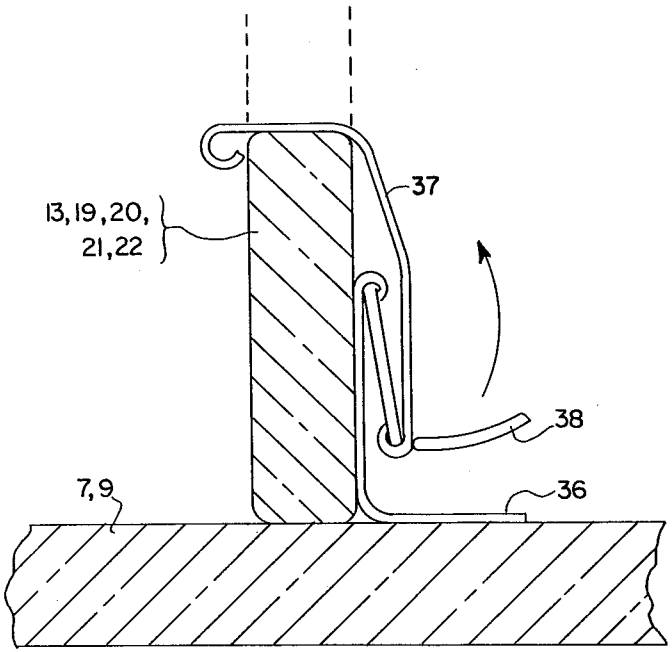
FIG. 4 shows a bulkhead-to-keelson stringer quick-release, over-center locking device.

Similarly, and having recourse now to FIG. 4, a bulkhead-to-keelson stringer is to be seen. To a keelson stringer, as 7, 9 etc., is releasably affixed a bulkhead, as 13, 19, 20, 21, 22 via a bracket 36 affixable to the keelson stringer, a vertical extension of this bracket abutting the lower web of the bulkhead. A spring-clip member 37 and a linking, finger-actuated integer 38 together constitute an effective over-center, quick-release locking device.

Figure 5:
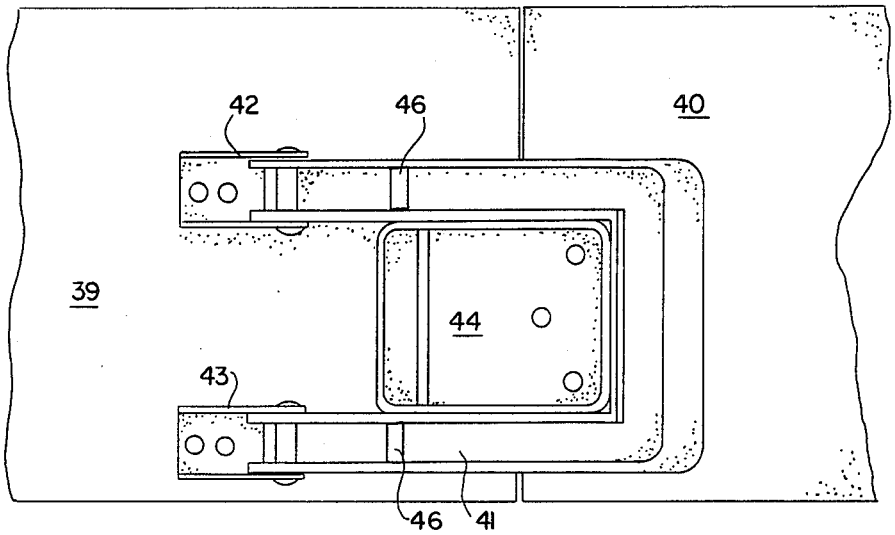
FIG. 5 is a plan view of a heavy-duty, keelson stringer-to-keelson stringer locking device.
Figure 6:
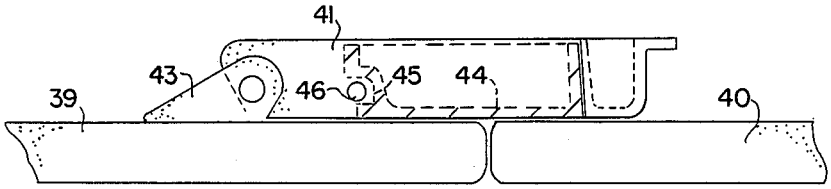
FIG. 6 is a corresponding side elevation.

FIGS. 5 and 6 illustrate a heavy-duty, keelson stringer-to-keelson stringer locking device. FIG. 5 is a top plan view showing a fragment of a mid-aft keelson stringer 39 and a juxtaposed fragment of a mid-forward keelson stringer 40. To mid-aft keelson stringer 39 a V-shaped member 41 is pivoted, the free ends of the limbs of member 41 being journalled between a pair of trunnions 42 and 43. The bight of V-shaped member 41 is engageable with a co-acting locating block 44 which is rigidly affixed to the mid-forward keelson stringer 40. A groove 45 in the free edge of block 44 engages with a rod or spindle 46, so that the V-shaped member and the locating block together constitute an over-center, quick-release locking device.

Above and overlying the deck portion of the hull skin and extending about the cockpit region may be a spray cover incorporating a chart pocket located between the cockpits; also between the cockpits may be a compass binnacle mounted centrally upon a transverse stainless steel bracket or support.

In addition to the above-mentioned components, the deck portion of the hull skin may also be provided with such items as a stern painter ring; anchor pocket and life-line storage pouch; stern paddle-blade pockets; a vertical lifting ring; stern portage handlegrips; paddle-retaining straps; tow-rope pockets; drainage holes; cleats; forward portage handlegrips; paddle fittings; a bow vertical lifting ring; bow portage handlegrip; and a bow painter ring, etc., etc.

Attached to the stern of the spray cover may be a luminous patch or strip and, adapted to be attached to, and extend about, the peripheries of the two cockpits, held in position by such means as a "Velcro" fastening tape, there may be provided what are known as "spray vests", these cladding the body of a paddler up to chest level and having crossed shoulder-straps.

As well as being well-adapted for progression by paddling, the two-man sea-going canoe of the present invention may also be efficiently sailed. To this end there may be provided a mast 50 to which is bent a mainsail 51. Mainsail 51 is set via a boom 52 and a gaff 53, hoist by parrel 54; also provided may be a loose-footed foresail 55. Mainsail 51 and foresail 55 may be cut from any suitable sailcloth fabric and mainsail 51 may be provided with two or more battens, as referenced 56 and 57. Reef points 64, for shortening sail, are provided on mainsail 51.

Inside the hull, relative to the disposition of the tandem cockpits, are suitable seats with backrests, and footrests are also provided. The aft footrest incorporates steering pedals from which cables pass to a transverse member integral with a rudder pintled on the rudder post 5, as is conventional. Buoyancy safety bags are provided for stowage in the stem and stern ends of the canoe.

A most significant feature of the present invention is the provision of a pair of elongated inflatable sponsons-referenced 60, 61 in FIG. 2, these being confined in air sponson pockets 62, 63 respectively on the inside of the hull skin; the sponsons, when inflated, conferring not only buoyancy but ensuring that the hull skin is tightly stretched over the skeletal frame of the vessel. Inflatable sponsons 60, 61 extend from bow to stern of the vessel. Certain adverse sailing conditions may well be ameliorated by use of such aids as an outrigger and, in the present invention such is provided as optional equipment. An outrigger cross-support member or boom is rigged athwartships, across the spray cover and just aft the front cockpit, the outrigger boom being located on appropriately-positioned chafing pads and attached to the coamings by such means as J-bolts. The outrigger itself is preferably an inflatable tube and may well be provided with a leeboard, which, of course, functions as a drop-keel as and when necessary under the prevailing weather conditions.

The two-man seagoing canoe according to the present invention will not only fold so as to be transportable on, say, a motor vehicle roof-rack, boot or tray but can be disassembled and packed into as few as two carry bags, each one of which is able to be easily carried by a fit adult male such as a serviceman. In fact, the production weight of the canoe is only in the region of about 50 kg, 36 kg of this being due to the skeletal frame and 14 kg to the hull skin. Each main carry bag is made of a heavy duty fabric.

Since it is envisaged that the craft will be in the region of, say, 5 meters length over all, each main carry bag may well be no more than perhaps 1½ meters long, thus being quite manageable by one person.

One of the main carry bags may have transported therein the fore skeletal half-frame; inflatable sponson tubes; seats and backrests; bulkheads and footrest; paddles and steering equipment; and the coaming members. The other carry bag may contain the stern skeletal half-frame; hull skin and deck fabric; spray cover and spray vests; towing lines and life lines; spare paddles; folding anchor and sea anchor or killick; compass; foot pump; sponge and bailer; and a repair kit. A third carry bag may contain the sailing gear, such as the mast assembly; mainsail; foresail; boom, gaff and fittings therefor; sidestays or shrouds; all necessary lines, cables etc; outrigger cross-support member and fittings therefor; inflatable outrigger tubes with fibreglass battens; leeboards and fittings therefor; all blocks, shackles, etc.

The two-man sea-going canoe as has been described hereinbefore has many advantages and novel features, as listed hereunder:

The vessel is practically unsinkable even when filled with water plus 100 kg of equipment plus two 12-stone crew members.

The vessel can be disassembled for packing into a minimum of two carry bags.

The skeletal frame has few components, thus reducing risk of loss of parts.

Assembly can be carried out by untrained operators.

The craft is fully sea-going, and may be launched not only from the shore but from submarines, support ships, and the like.

All the primary construction components will float.

All locking and joining components are adapted for positive and rapid assembly of the members, and are rust-resistant.

The inflatable sponsons can be inflated by mouth if necessary or desirable.

The twinned keelson stringers impart great stability in both calm and rough sea conditions.

The collapsible plastic rudder assists in safe operation in difficult tidal or windy conditions.

From the abovegoing, the reader will readily appreciate that folding, two-man seagoing canoes constructed in accordance with the present invention will provide its users with a new or much-improved kind of craft or, at the very least, offer to them a most useful and undeniably attractive choice.

The claims defining the invention are as follows.

I claim:

1. A folding canoe including a fore skeletal half-frame and an aft skeletal half-frame releasably connectable together by a plurality of over-center locking devices, said fore skeletal half-frame comprising a stem post, a port bow keelson stringer connected thereto and hingedly connected to a port mid-forward keelson stringer, a starboard bow keelson stringer connected to said stem post and hingedly connected to a starboard mid-forward keelson stringer, a port bow gunwale stringer connected to said stem post and hingedly connected to a port mid-forward gunwale stringer, a starboard bow gunwale stringer connected to said stem post and hingedly connected to a starboard mid-forward gunwale stringer, a stem bulkhead and a mid-forward bulkhead, both releasably located within said fore skeltal half-frame;

said aft skeletal half-frame comprising a stern post, a port stern keelson stringer connected thereto and hingedly connected to a port mid-aft keelson stringer, a starboard stern keelson stringer connected to said stern post and hingedly connected to a starboard mid-aft keelson stringer, a port stern gunwale stringer connected to said stern post and hingedly connected to a port mid-aft gunwale stringer, a starboard stern gunwale stringer connected to said stern post and hingedly connected to a starboard mid-aft gunwale stringer, a stern bulkhead and a spaced-apart pair of mid-aft bulkheads, all three releasably located within said aft skeletal half-frame; and a hull skin adapted to sheath said half-frames when connected together.

2. The folding canoe as claimed in claim 1, wherein said stem and stern posts, keelson stringers, gunwale stringers and bulkheads are fabricated from plastic materials.

3. The folding canoe as claimed in claim 1, further including a mast-supporting tabernacle disposed above said mid-forward gunwale stringers intermediate said stem and mid-forward bulkheads and connected to said stem post via a foredeck fore-and-aft centerline member, a port mid-forward coaming connected to said tabernacle and hingedly connected to a port mid-aft coaming, and a starboard mid-forward coaming connected to said tabernacle and hingedly connected to a starboard mid-aft coaming; the after ends of said port and starboard mid-aft coamings being releasably attachable to said stern bulkhead.

4. The folding canoe as claimed in claim 1, wherein there is provided a pair of elongated inflatable sponsons disposed in respective sponson pockets on the inside of said hull skin, one on each side of said canoe.

5. The folding canoe as claimed in claim 3, wherein said intermediate bulkheads are releasably affixable to the said coamings by means of over-center locking devices.

6. The folding canoe as claimed in claim 1 wherein said keelson stringers are releasably affixable to said bulkheads by means of over-center locking devices.

7. The folding canoe as claimed in claim 1, wherein said mid-forward and mid-aft keelson stringers are releasably connectable together by means of locking devices; each locking device including a V-shaped member the free ends of the limbs of which are pivoted to a mid-aft keelson stringer adjacent one end thereof, the bight of said V-shaped member being engageable with a co-acting locating block rigidly affixed to a mid-forward keelson stringer adjacent an end thereof adapted to abut the said one end of said mid-aft keelson stringer.

8. The folding canoe as claimed in claim 2 further including a mast-supporting tabernacle disposed above said mid-forward gunwale stringers intermediate said stem and mid-forward bulkheads and connected to said stem post via a foredeck fore-and-aft centerline member, a port mid-forward coaming connected to said tabernacle and hingedly connected to a port mid-aft coaming, and a starboard mid-forward coaming connected to said tabernacle and hingedly connected to a starboard mid-aft coaming; the after ends of said port and starboard mid-aft coamings being releasably attachable to said stern bulkhead.

9. The folding canoe as claimed in claim 2 wherein there is provided a pair of elongated inflatable sponsons disposed in respective sponson pockets on the inside of said hull skin, one on each side of said canoe.

10. The folding canoe as claimed in claim 3 wherein there is provided a pair of elongated inflatable sponsons disposed in respective sponson pockets on the inside of said hull skin, one on each side of said canoe.

11. The folding canoe as claimed in claim 3 wherein said intermediate bulkheads are releasably affixable to the said coamings by means of over-center locking devices.

12. The folding canoe as claimed in claim 2 wherein said keelson stringers are releasably affixable to said bulkheads by means of over-center locking devices.

13. The folding canoe as claimed in claim 3 wherein said keelson stringers are releasably affixable to said bulkheads by means of over-center locking devices.

14. The folding canoe as claimed in claim 4 wherein said keelson stringers are releasably affixable to said bulkheads by means of over-center locking devices.

15. The folding canoe as claimed in claim 5 wherein said keelson stringers are releasably affixable to said bulkheads by means of over-center locking devices.

16. The folding canoe as claimed in claim 2 wherein said mid-forward and mid-aft keelson stringers are releasably connectable together by means of locking devices; each locking device including a V-shaped member the free ends of the limbs of which are pivoted to a mid-aft keelson stringer adjacent one end thereof, the bight of said V-shaped member being engageable with a co-acting locating block rigidly affixed to a mid-forward keelson stringer adjacent an end thereof adapted to abut the said one end of said mid-aft keelson stringer.

17. The folding canoe as claimed in claim 3 wherein said mid-forward and mid-aft keelson stringers are releasably connectable together by means of locking devices; each locking device including a V-shaped member the free ends of the limbs of which are pivoted to a mid-aft keelson stringer adjacent one end thereof, the bight of said V-shaped member being engageable with a co-acting locating block rigidly affixed to a mid-forward keelson stringer adjacent an end thereof adapted to abut the said one end of said mid-aft keelson stringer.

18. The folding canoe as claimed in claim 4 wherein said mid-forward and mid-aft keelson stringers are releasably connectable together by means of locking devices; each locking device including a V-shaped member the free ends of the limbs of which are pivoted to a mid-aft keelson stringer adjacent one end thereof, the bight of said V-shaped member being engageable with a co-acting locating block rigidly affixed to a mid-forward keelson stringer adjacent an end thereof adapted to abut the said one end of said mid-aft keelson stringer.

19. The folding canoe as claimed in claim 5 wherein said mid-forward and mid-aft keelson stringers are releasably connectable together by means of locking devices; each locking device including a V-shaped member the free ends of the limbs of which are pivoted to a mid-aft keelson stringer adjacent one end thereof, the bight of said V-shaped member being engageable with a co-acting locating block rigidly affixed to a mid-forward keelson stringer adjacent an end thereof adapted to abut the said one end of said mid-aft keelson stringer.

20. The folding canoe as claimed in claim 6 wherein said mid-forward and mid-aft keelson stringers are releasably connectable together by means of locking devices; each locking device including a V-shaped member the free ends of the limbs of which are pivoted to a mid-aft keelson stringer adjacent one end thereof, the bight of said V-shaped member being engageable with a co-acting locating block rigidly affixed to a mid-forward keelson stringer adjacent an end thereof adapted to abut the said one end of said mid-aft keelson stringer.

* * * * *